US010746146B2

(12) United States Patent
Phillips et al.

(10) Patent No.: US 10,746,146 B2
(45) Date of Patent: Aug. 18, 2020

(54) FUEL RAIL CLAMPING ARRANGEMENT

(71) Applicant: DELPHI TECHNOLOGIES IP LIMITED, St. Michael (BB)

(72) Inventors: Simon H. Phillips, Cinderford (GB); Kevin Price, Cheltenham (GB)

(73) Assignee: DELPHI TECHNOLOGIES IP LIMITED (BB)

( * ) Notice: Subject to any disclaimer, the term of this patent is extended or adjusted under 35 U.S.C. 154(b) by 0 days.

(21) Appl. No.: 16/080,792

(22) PCT Filed: Feb. 10, 2017

(86) PCT No.: PCT/EP2017/052995
§ 371 (c)(1),
(2) Date: Aug. 29, 2018

(87) PCT Pub. No.: WO2017/148683
PCT Pub. Date: Sep. 8, 2017

(65) Prior Publication Data

US 2019/0178213 A1 Jun. 13, 2019

(30) Foreign Application Priority Data

Feb. 29, 2016 (GB) ..... 1603445.6

(51) Int. Cl.
*F02M 61/14* (2006.01)
*F02M 55/02* (2006.01)
*F02M 55/00* (2006.01)

(52) U.S. Cl.
CPC ..... *F02M 55/025* (2013.01); *F02M 55/005* (2013.01); *F02M 61/14* (2013.01); *F02M 2200/855* (2013.01); *F02M 2200/856* (2013.01); *F02M 2200/857* (2013.01)

(58) Field of Classification Search
CPC .... F02M 55/025; F02M 55/005; F02M 61/14; F02M 2200/857; F02M 2200/856; F02M 2200/855
See application file for complete search history.

(56) References Cited

U.S. PATENT DOCUMENTS

| | | | | |
|---|---|---|---|---|
| 4,832,376 A | | 5/1989 | Sugao | |
| 4,900,180 A | | 2/1990 | Takikawa | |
| 5,261,705 A | | 11/1993 | Takahashi et al. | |
| 5,609,129 A | * | 3/1997 | Hauf | F02F 7/006 123/193.5 |
| 5,713,323 A | * | 2/1998 | Walsh | F02B 27/008 123/184.42 |
| 5,870,995 A | | 2/1999 | Stockner et al. | |
| 6,076,505 A | * | 6/2000 | Guggenmos | F02F 1/242 123/195 C |

(Continued)

FOREIGN PATENT DOCUMENTS

| | | | | |
|---|---|---|---|---|
| EP | 2148076 A1 | | 1/2010 | |
| GB | 2537642 A | * | 10/2016 | F02M 63/0275 |

*Primary Examiner* — David Hamaoui
(74) *Attorney, Agent, or Firm* — Joshua M. Haines

(57) ABSTRACT

A fuel rail arrangement for an engine includes a fuel rail mounting cradle and a fuel rail fixed to the cradle. The fuel rail includes one or more outlets connected to respective fuel injector pipes. The fuel rail arrangement includes a clamp to fix both the rail to the cradle and to fix the fuel injector pipes to respective outlets in the fuel rail.

5 Claims, 5 Drawing Sheets

(56) References Cited

U.S. PATENT DOCUMENTS

| | | | | |
|---|---|---|---|---|
| 7,055,469 | B2 * | 6/2006 | Lawrence | F01L 1/022 123/48 AA |
| 8,307,809 | B2 * | 11/2012 | Hay | F02M 55/025 123/198 E |
| 9,593,642 | B2 * | 3/2017 | Wicks | F02F 7/0085 |
| 9,810,189 | B2 * | 11/2017 | Maier | F02M 69/50 |
| 9,863,388 | B2 * | 1/2018 | Rehwald | F02M 61/14 |
| 10,132,282 | B2 * | 11/2018 | Mechi | F02M 55/025 |
| 2007/0006848 | A1 | 1/2007 | Ricco et al. | |
| 2009/0243285 | A1 * | 10/2009 | Warga | F02M 55/005 285/195 |

* cited by examiner

FUEL RAIL CLAMPING ARRANGEMENT

CROSS REFERENCE TO RELATED APPLICATIONS

This application is a national stage application under 35 USC 371 of PCT Application No. PCT/EP2017/052995 having an international filing date of Feb. 10, 2017, which is designated in the United States and which claimed the benefit of GB Patent Application No. 1603445.6 filed on Feb. 29, 2016, the entire disclosures of each are hereby incorporated by reference in their entirety.

FIELD OF THE INVENTION

This disclosure relates to engines which utilize direct fuel injection technologies and has particular application to engines which incorporate common rails or accumulator volumes to supply injectors, and in particular a method of mounting such common rail or accumulator volumes.

BACKGROUND OF THE INVENTION

Direct fuel injection engines typically provide high pressure fuel to a set of fuel injectors. Typically the fuel is pressurized by a system which includes a high pressure pump and supplied to a common accumulator volume such as a common rail, where pressurized fuel is supplied to a number of injectors from this volume via high pressure conduits/pipes. By having a common volume, a high pressure fuel reservoir is effectively provided and there is no need to have separate fuel pumps for each fuel injector. Usually the accumulator volume is elongate in form and forms e.g. a rail like structure spanning the length of the inlet portion of the manifold. Separate pipes from the accumulator/common rail provide fuel to the fuel injectors. Having an elongate rail accumulator volume allows these pipes which fluidly connect the rail to the separates injectors to be short in length. The rail is commonly referred to as a "common rail".

It is an object of the invention to provide an improved arrangement of mounting the accumulator volume/common rail to the engine and mounting the fuel supply pipes which supply the fuel injectors.

STATEMENT OF THE INVENTION

In one aspect is provided an engine fuel rail arrangement, comprising an engine including a fuel rail mounting cradle, and a fuel rail fixed thereto, said fuel rail including one or more outlets connected to respective fuel injector pipes, wherein said arrangement includes common fixing means to fix both the fuel rail to the cradle and fix said fuel injector pipes to respective outlets in the fuel rail.

Said cradle may include at least one mounting surface for mounting of said fuel rail and said common means includes clamping means adapted provide a force to hold/fix said pipe(s) into position to respective fuel outlets on the fuel rail, said force additionally providing force to secure said rail to said cradle.

Said clamping means may include bracket means.

Said clamping means may include tightening means to provide said force.

Said tightening means may comprise a tapped hole in said clamping means to receive screw or bolt means.

Said bracket may be is part of said cradle means.

Said cradle means may include a portion which surround the camshaft of the engine.

Said cradle means and said bracket means may be formed as separate components which include portions thereof which co-operate to surround the camshaft.

Said common fixing means may include or comprises a common component.

Said common component may comprises a fixing plate, adapted to secure said rail to said bracket or cradle and as well as secure one or more pipe to the respective outlet(s).

Said fixing plate may include at least one tapping or bore to allow securing means pass therethrough to a tapping or bore in the cradle.

Said fixing plate may include at least one pipe tapping or bore to allow the pipe to an injector to be connect and/or tightened to the said respective injector outlet (orifice) in the fuel rail.

The arrangement may include screw means adapted to cooperate with said pipe tapping bore to tighten the pipe to said injector outlet/orifice.

The arrangement may include a yoke member adapted to support and secure plurality of pipes to the respective outlets in the fuel rail and including means to secure said yoke member to said fixing plate.

Said cradle is forged with said engine block.

In other words, in examples is included an arrangement including a mounting cradle and fixing means (adapted to fix the rail to the cradle) and includes further fixing means to fix high pressure fuel injector pipes to the respective outlets in the fuel rail, wherein first and second fixing means are common or utilize a common component.

The term "fix" with respect to the fuel rail should be interpreted as to also position/mount/clamp/secure or locate said fuel rail. The term "fix" in respect of the pipe(s) (conduits to the individual fuel injectors) should be interpreted as to include connecting or holding the pipe(s) into position on the fuel rail, i.e. to the respective fuel rail outlets, so as to fluidly connect the fuel rail to the pipes.

The fixing plate may be any appropriate shape and does not have to be "plate" or "flat" shaped; it is affixing member used to secure the fuel rail to the cradle.

Thus examples cover the mounting the common rail (accumulator volume) using a clamping means where the high pressure pump pipe mounting/tightening features are integrated into the (rail clamp) clamping means In some examples the HP pipe loading/securing force is used to clamp the rail in position on the engine. Examples provide for removing the previous protruding HP ports from the rail, allowing for a simple tubular construction. Clamping the rail tube directly removes the need for separate mounting brackets: similar to the HP port removal the design can be simplified significantly. Robustness to engine vibration is improved via direct restraint of the rail mass, increasing of joint stiffness at the bracket location and HP pipe connection. Integrating the clamp and HP pipe mounting can help reduce FIE installation envelopes, therefore aiding engine downsizing and access for assembly tooling. The number of assembly operations can be reduced.

BRIEF DESCRIPTION OF DRAWINGS

FIG. 1*a* shows a schematic isometric view and FIG. 1*b* shows a cross sectional view;

DETAILED DESCRIPTION OF THE INVENTION

Figure 1A:
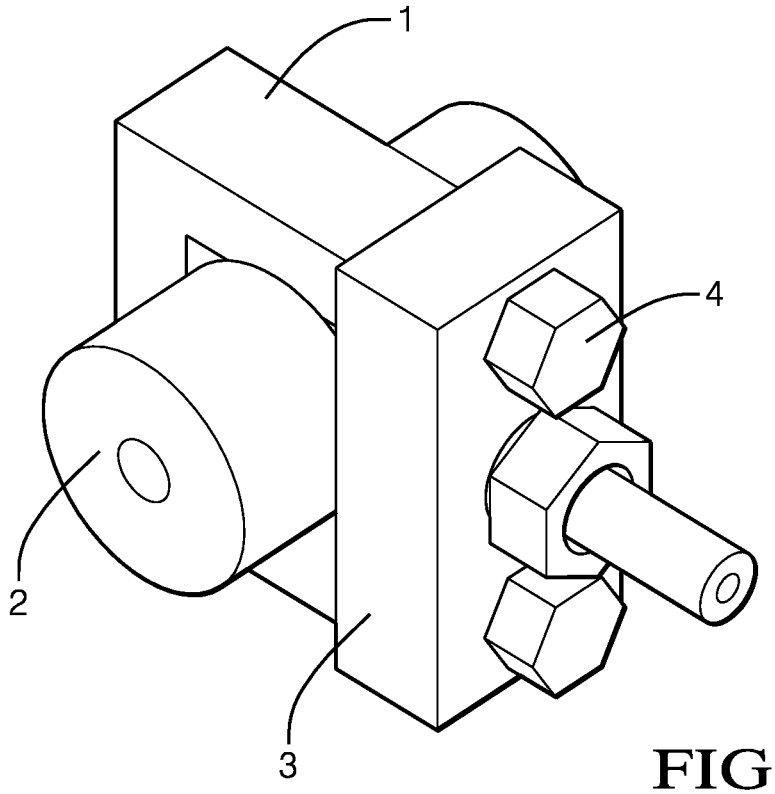
FIGS. 1*a* and 1*b* shows a simple example according to one aspect.
Figure 1B:
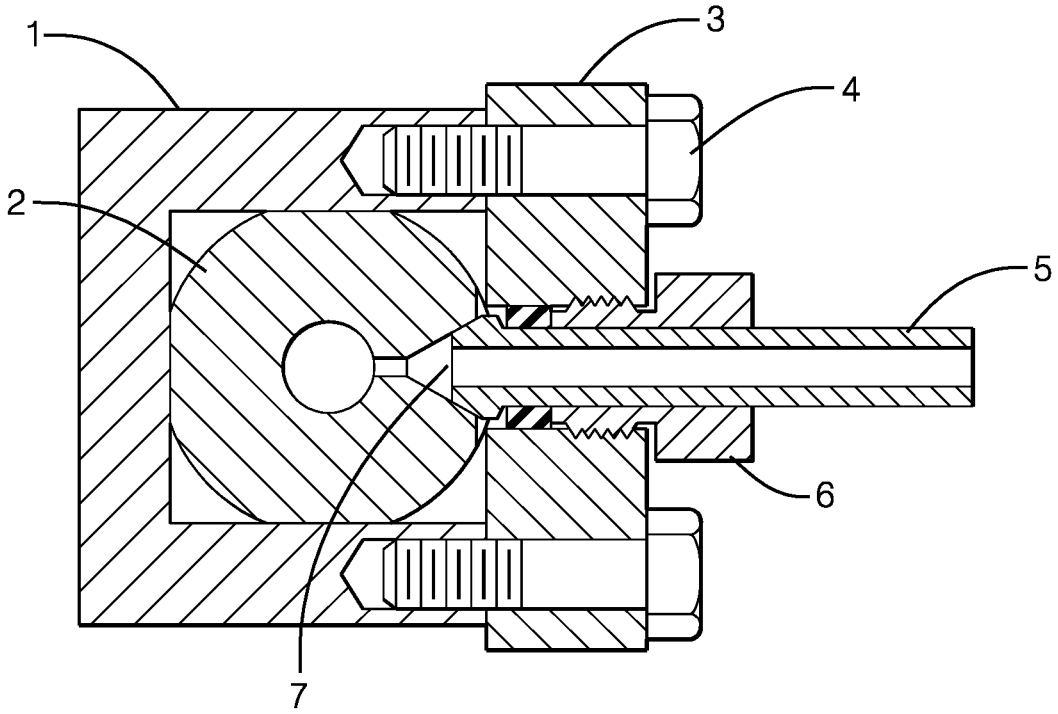

FIGS. 1*a* and *b* shows a simple example according to one aspect; FIG. 1*a* shows a schematic isometric view and FIG. 1*b* shows a cross sectional view. The figure shows a cradle or bracket 1 which is adapted to receive/locate a fuel rail 2. It is to be noted that in the figures, only a portion of the fuel rail is shown. The cradle can be located on the cylinder head forging and may in preferred examples be incorporated into the cylinder head forging. In examples the fuel rail may have flat surfaces (e.g. via machining) in the region where they are fitted to the cradle so as to cooperate with appropriate flat surfaces of the cradle to ensure better fitting.

A mounting block/plate 3 is used to secure the common rail into the cradle/bracket means, and is fitted to the cradle by any suitable means such as by screw or bolts means 4, into respective thread in the bracket/cradle. The common rail includes a number of outlets 7 to high pressure (HP) pipes 5 which feed fuel to corresponding injectors. In examples the pipe, is connected to the fuel outlet from the common rail using the same mounting block/plate 3.

The mounting block/plate may include a bore through which the pipe is fitted to corresponding fuel outlet port in the common rail, e.g. via screw means 6 may be used to tighten the respective end of the pipe to the fuel outlet.

There may be one or more brackets/cradles; the number and location may vary according to design. Thus in this example, the means for fixing the common rail to the engine (e.g. cylinder head) utilizes a fitting (bracket) which is also used to secure/fix the fuel pipe to the fuel outlet of the common rail. By having this common component the high pressure pump pipe mounting/tightening features are integrated into the (rail clamp) clamping means.

Figure 2A:
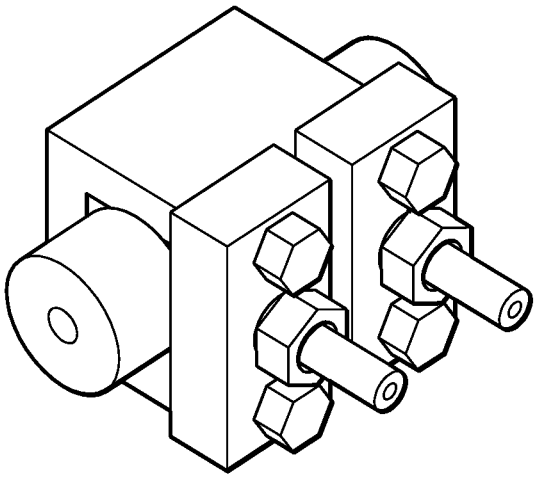
FIGS. 2*a, b, c* and *d* show further examples according to further aspects.
Figure 2B:
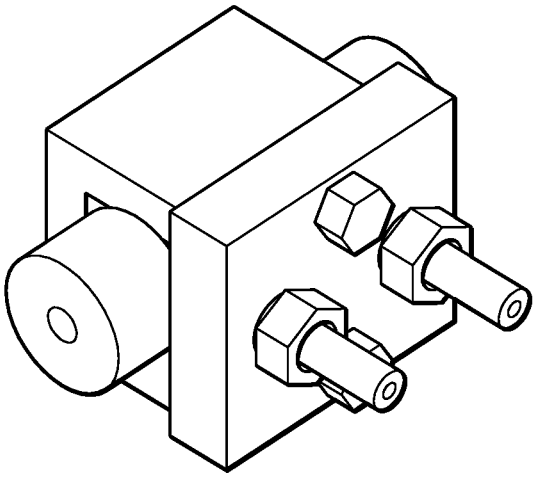
Figure 2C:
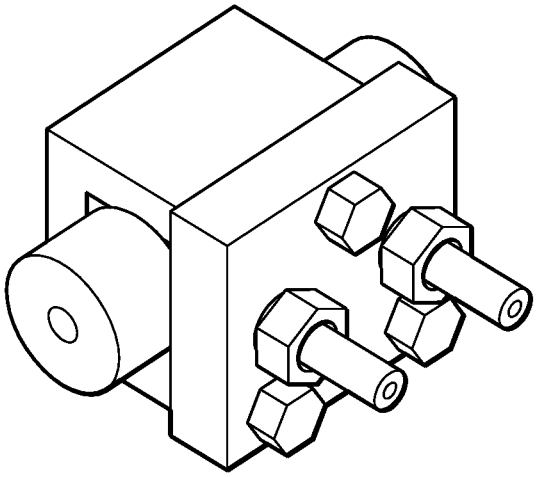
Figure 2D:
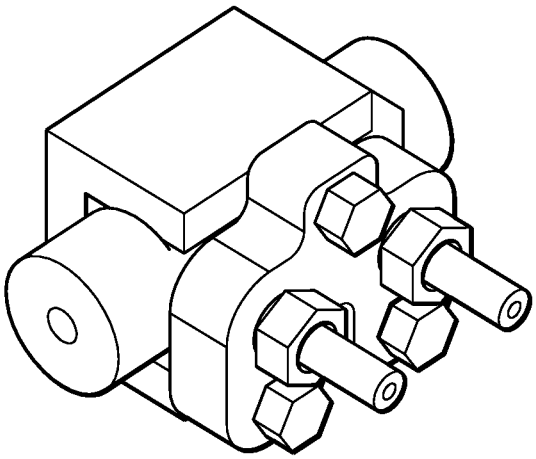

FIGS. 2*a, b, c* and *d* show alternative designs. FIG. 2*a* shows an example where, a single bracket is used with two mounting plates, to clamp/fit the fuel rail as well as the pipes to two fuel rail outlet. FIG. 2*b* shows a similar design to FIG. 2*a* except there is just one mounting plate. Thus in this design both the bracket (cradle) and the mounting plate are common to both the fuel rail and two pipes. FIG. 2*c* shows that the mounting plate is secured to the bracket/cradle with bolt/screw means. The shape of the cover plate may be varied as seen in FIG. 2*d*.

Figure 3B:
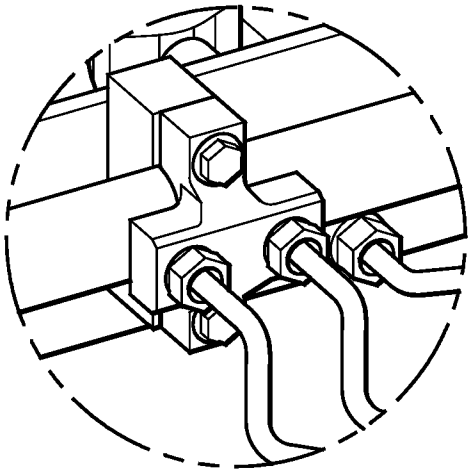
FIGS. 3*a* and *b* shows yet further alternative examples.
Figure 3A:
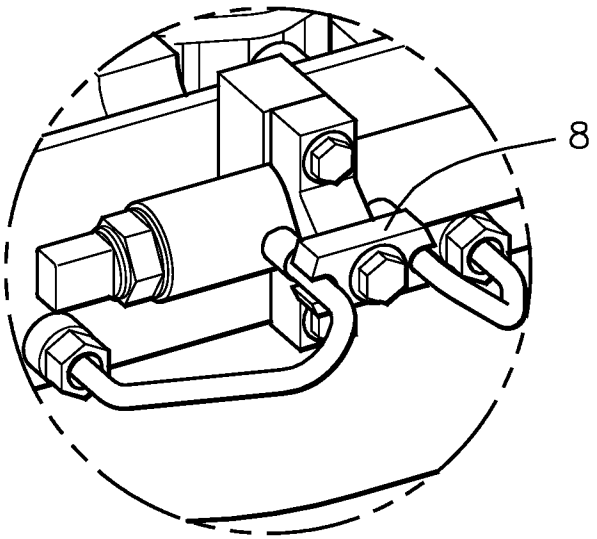

FIGS. 3*a* and *b* shows an alternative examples. In these examples the clamping plate/means is not necessarily "plate" formed. Here the bracket or cradle 1 may be such that the common rail 2 protrudes from the bracket/cradle and the mounting fixing plate 3 is appropriately formed to accommodate the protruding portion of the common rail, and also have means to fix to the bracket/cradle. FIG. 3*a* shows a design similar to FIG. 2*c* but where the fuel rail extends protrudes outside the cradle and the mounting plate is appropriately formed. In FIG. 3*b*, the fixing portion/cover plate includes bores for connecting two pipes to two respective fuel outlets form the common rail, the fixing portion/cover plate including mean such as screw or bolt means to also fix the common rail to the bracket. A yoke 8 is used to fix and secure the two pipes to the fuel outlets, the yoke being secured to the cover plate by suitable means such as screw/bolt means. Thus this arrangement can be regarded as a "dual yoke clamp".

Figure 4:
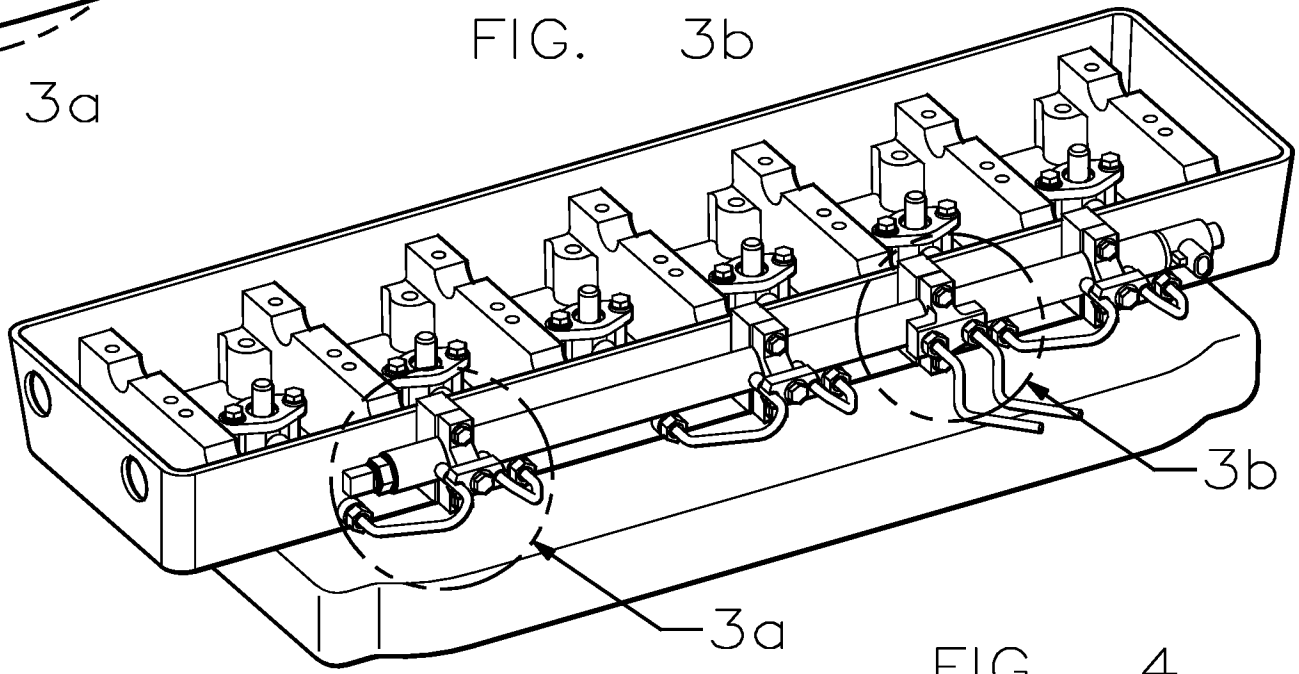
FIG. 4 shows how the designs of the FIG. 2 can be implemented and the figure shows an example of the complete rail is located, e.g. onto a cylinder engine block.

FIG. 4 shows how the designs of the FIG. 2 can be implemented and the figure shows an example of the complete rail is located, e.g. onto a cylinder engine block.

Figure 5A:
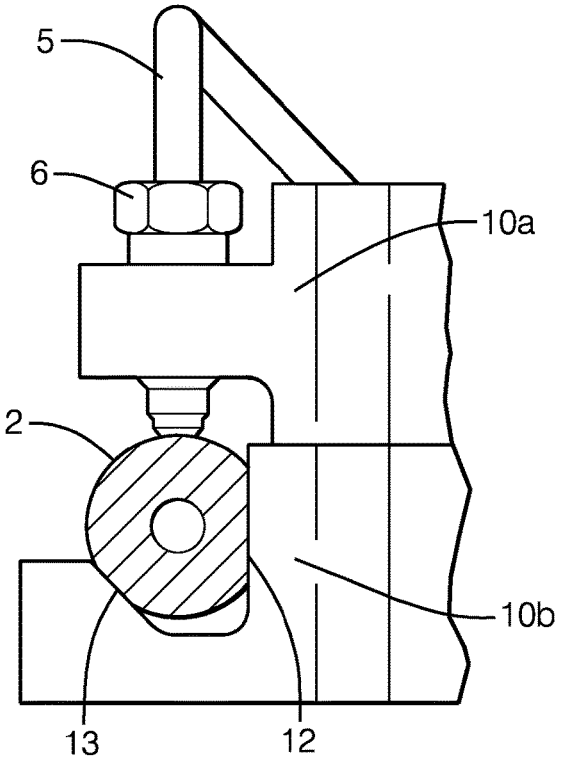
FIGS. 5*a* and *b* shows an alternative example and how the rail may be clamped into a bracket/cradle by the high pressure pipe load.

FIGS. 5*a* and *b* shows an alternative example and how the rail may be clamped into a bracket/cradle arrangement by the high pressure pipe load. FIG. 5*a* shows a cross sectional view of an arrangement where the pipe is located into cradle 10*b* using bracket 10*a*. The cradle 10*b* is attached to the engine e.g. engine block. The bracket is provided by portions 10*a* and cooperates with cradle portion 10*b*. It is to be noted that the portion 10*a* and 10*b* may be regarded as two portions of the cradle or as the cradle with a co-operating bracket portion. The cradle portion 10*b* preferably includes at least two flat surfaces on the lower portion; an aligning surface 12 and a loading surface 13. The bracket also includes a bracket top portion 10*a* which includes a bore or guide to receive the pipe to the outlet in the fuel rail (from the fuel injector). Suitable tightening means such as screw or bolt means 6 are provided to secure the end of the pipe (from the individual fuel injector(s)) to the respective pipe outlet. The force from the pipe load on to the fuel rail will also secure the fuel rail to the lower portion of the cradle.

Figure 5B:
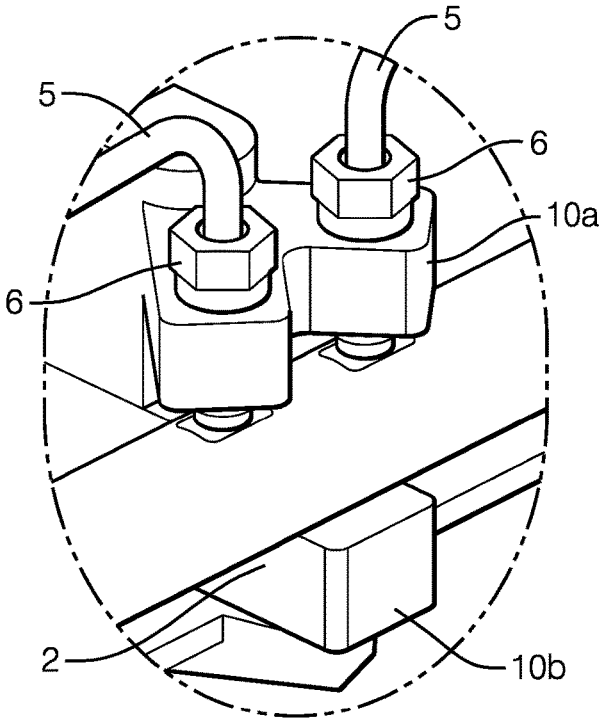

FIG. 5*b* shows an isometric view of the FIG. 5*ba* arrangement with the upper clamping portion configured to receive and fit the ends of two pipes to respective fuel outlets in the fuel rail. In FIGS. 5*a* and 5*b* the lower portion of the cradle/bracket and the upper portion may be separate and preferably adjacent.

Figure 6B:
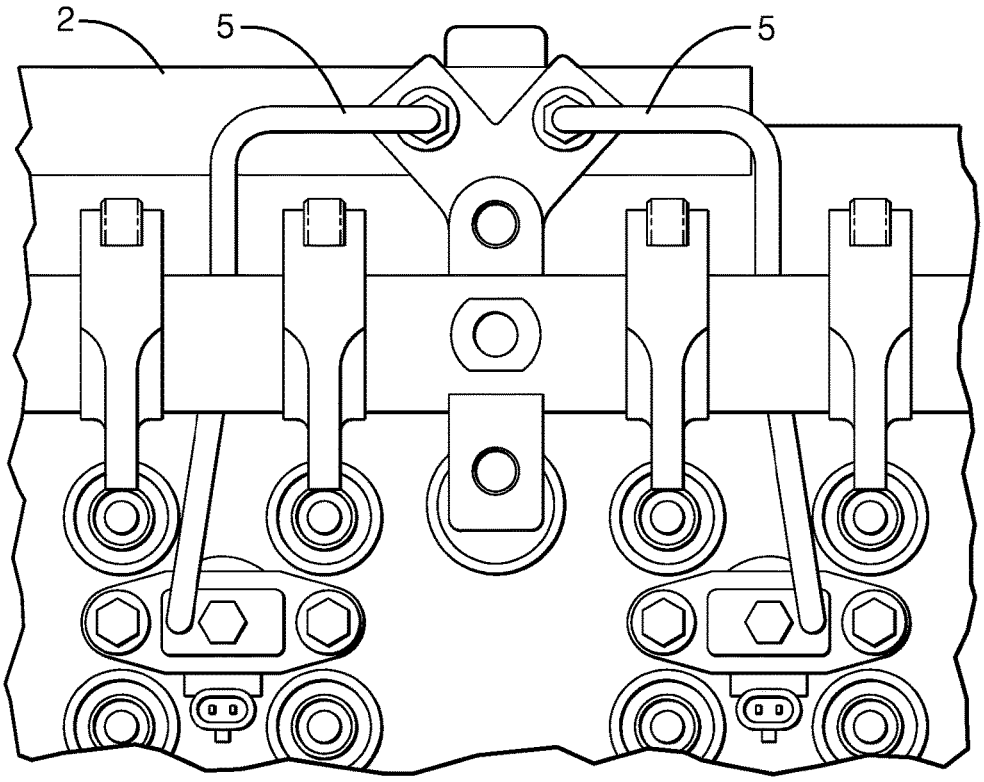
FIGS. 6*a* and 6*b* show how the design of FIG. 5 may be such that the upper and lower portions of the cradle bracket are formed such that surround the camshaft (rocker shaft).
Figure 6A:
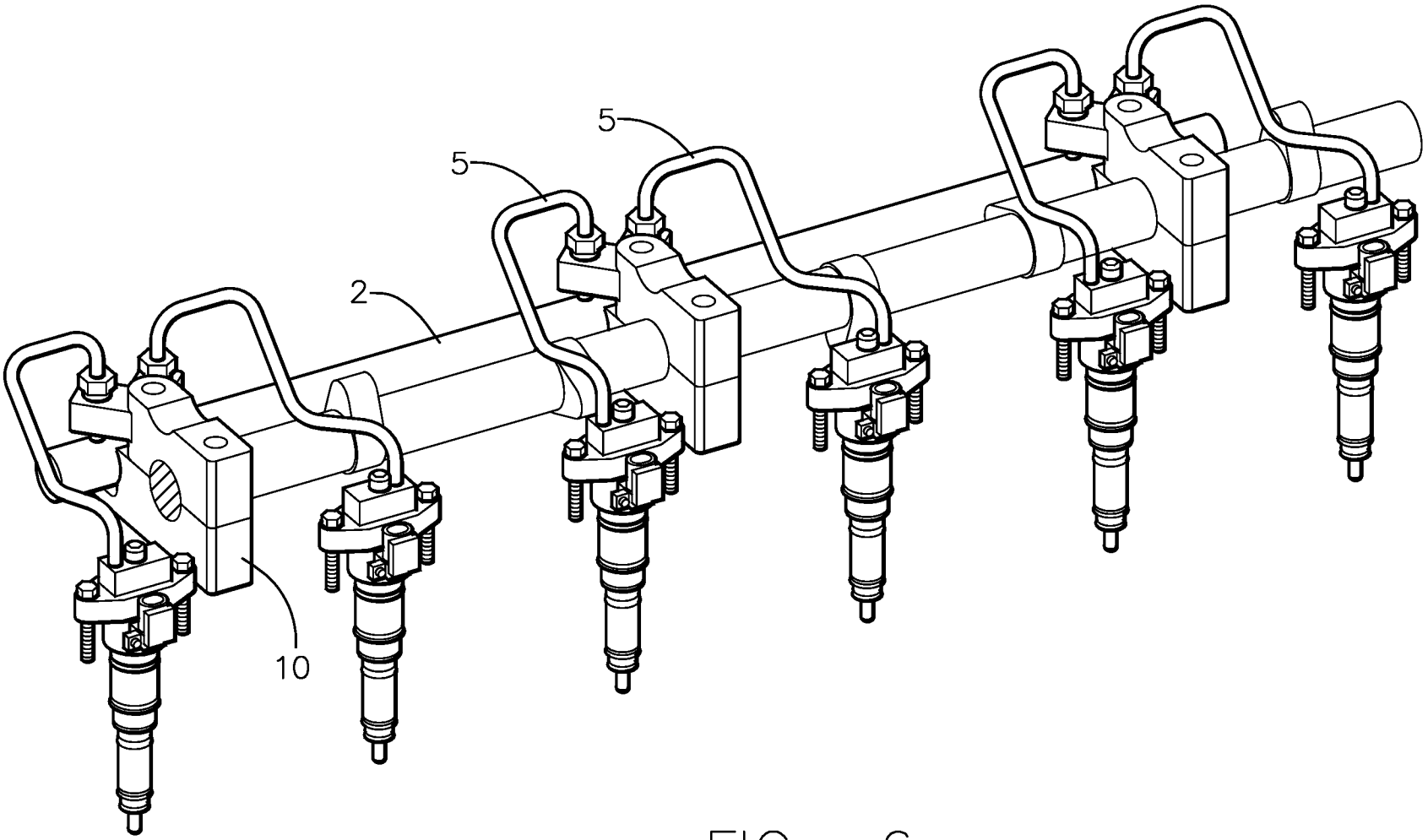

FIGS. 6*a* and 6*b* show how the design of FIGS. 5*a* and *b* may be such that the upper and lower portions of the cradle bracket are formed such that surround the camshaft (rocker shaft). This example provides for greater utilisation of space. The arrangement also helps stabilise and or retain the camshaft. The pipes may be routed from the fuel outlets in the fuel rail under the cam/rocker shaft to the fuel injectors.

According to some examples some of the them are "self-fixture" where they fixtures provide rail location and carry the weight of the rail—potentially eliminating the need for additional tooling on the assembly line.

The invention claimed is:

1. A fuel rail arrangement for an engine, the fuel rail arrangement comprising:

a fuel rail mounting cradle including a first fuel rail mounting cradle recess and a second fuel rail mounting cradle recess;

a fuel rail received within said first fuel rail mounting cradle recess and fixed to said fuel rail mounting cradle, said fuel rail including one or more outlets connected to respective fuel injector pipes;

common fixing means to fix both said fuel rail to said fuel rail mounting cradle and fix said fuel injector pipes to respective said outlets in said fuel rail, said common fixing means includes clamping means adapted to provide a force to hold said fuel injector pipes into position to respective said fuel outlets on said fuel rail, said force additionally providing force to secure said fuel rail to said fuel rail mounting cradle, said second fuel rail mounting cradle recess receiving a camshaft of said engine therein such that said second fuel rail mounting cradle recess partially surrounds said camshaft.

2. A fuel rail arrangement as claimed in claim 1 wherein said clamping means includes bracket means which includes a bracket means recess within which said camshaft is located, and wherein said fuel rail mounting cradle and said bracket means are formed as separate components such that said second fuel rail mounting cradle recess co-operates with said bracket means recess surround and retain the camshaft.

3. A fuel rail arrangement as claimed in claim 2 wherein said bracket means includes at least one tapping or bore to allow a securing means to pass therethrough to a tapping or bore in said fuel rail mounting cradle.

4. A fuel rail arrangement as claimed in claim 2 wherein said bracket means includes at least one pipe tapping or bore to allow said fuel injector pipes to be connect and/or tightened to respective said outlets in said fuel rail.

5. A fuel rail arrangement as claimed in claim 4 including a screw adapted to cooperate with said pipe tapping or said bore to tighten to said outlets in said fuel rail.

* * * * *